US005474866A

United States Patent [19]

Ritt et al.

[11] Patent Number: 5,474,866

[45] Date of Patent: Dec. 12, 1995

[54] METHOD OF MANUFACTURING A LUMINESCENT SCREEN FOR A CRT

[75] Inventors: Peter M. Ritt, East Petersburg; Harry R. Stork, Adamstown; Brian T. Collins, Exton, all of Pa.; Pabitra Datta, Cranbury, N.J.; Nitin V. Desai, Princeton Jct., N.J.; Eugene S. Poliniak, Willingboro, N.J.

[73] Assignee: Thomson Consumer Electronics, Inc., Indianapolis, Ind.

[21] Appl. No.: 297,740

[22] Filed: Aug. 30, 1994

[51] Int. Cl.[6] ..... G03C 5/00

[52] U.S. Cl. ..... 430/23; 430/24; 430/25; 430/28

[58] Field of Search ..... 430/23, 24, 25, 430/28

[56] References Cited

U.S. PATENT DOCUMENTS

| | | | |
|---|---|---|---|
| 3,558,310 | 1/1971 | Mayaud | 96/36.1 |
| 3,811,910 | 5/1974 | Labana et al. | 430/23 |
| 4,917,978 | 4/1990 | Ritt et al. | 430/23 |
| 5,028,501 | 7/1991 | Ritt et al. | 430/23 |
| 5,083,959 | 1/1992 | Datta et al. | 445/52 |
| 5,229,233 | 7/1993 | Riddle et al. | 430/23 |
| 5,240,798 | 8/1993 | Ehemann, Jr. | 430/23 |

*Primary Examiner*—S. Rosasco

*Attorney, Agent, or Firm*—Joseph S. Tripoli; Dennis H. Irlbeck; Vincent J. Coughlin, Jr.

[57] ABSTRACT

In accordance with the present invention, a method of electrophotographically manufacturing a luminescent screen assembly for a color CRT 10 on an interior surface of a faceplate panel 12 is described. A volatilizable organic conductive (OC) layer 32 is provided on the interior surface of the panel and a volatilizable organic photoconductive (OPC) layer 34 overlies the OC layer 32. The method includes the steps of: establishing a substantially uniform electrostatic charge on the OPC layer; exposing selected areas of the OPC layer to visible light to affect the charge thereon; developing the selected areas of the OPC layer with a triboelectrically charged, dry-powdered, first color-emitting phosphor; sequentially repeating the charging, exposing and developing sequence for triboelectrically charged, dry-powdered, second and third color-emitting phosphors to form a luminescent screen comprising picture elements of triads of color-emitting phosphors; fixing the phosphors to the underlying OPC layer with a suitable fixative; filming the phosphors; and aluminizing the filmed phosphors. The present method is an improvement over prior methods because the fixing step utilizes an electrostatic spray to uniformly contact the phosphors and the underlying OPC layer with the fixative, without moving the phosphors.

14 Claims, 3 Drawing Sheets

Fig. 1
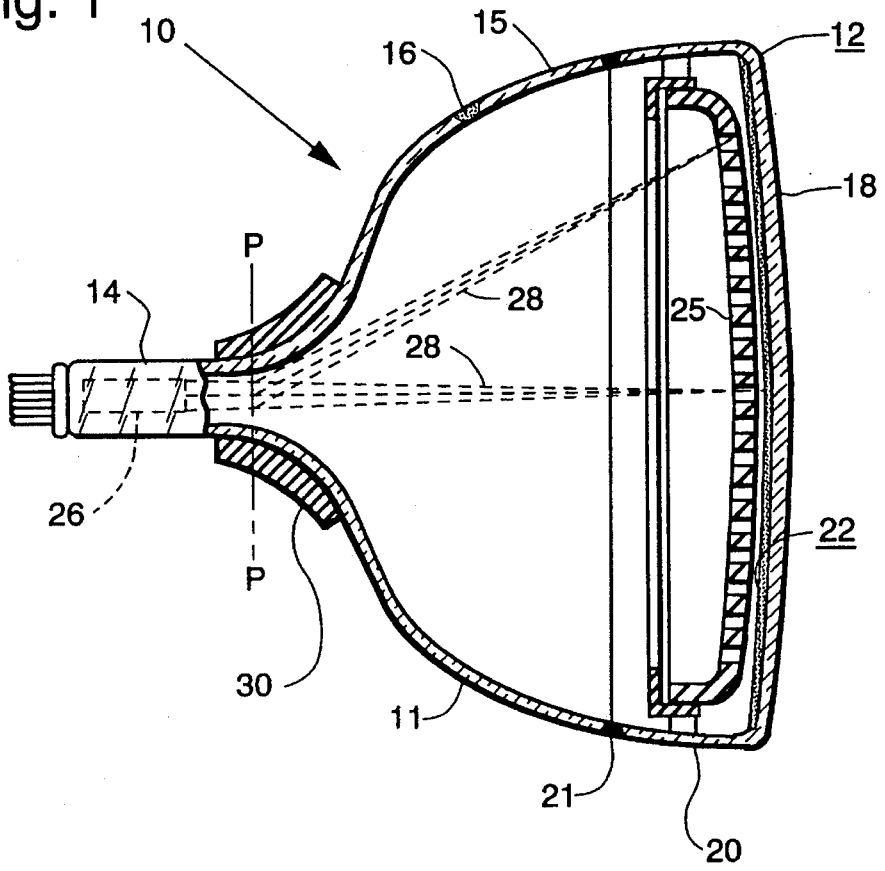
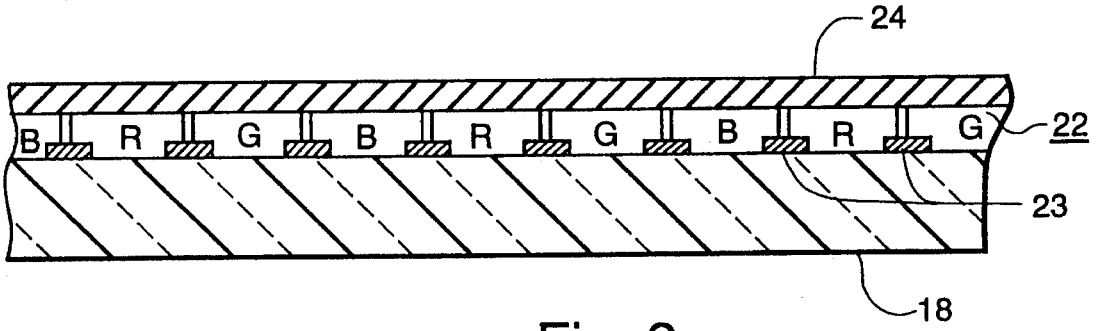
Fig. 2

METHOD OF MANUFACTURING A LUMINESCENT SCREEN FOR A CRT

The present invention relates to a method of electrophotographically manufacturing a luminescent screen assembly for a cathode-ray tube (CRT), and more particularly to manufacturing a screen assembly in an expedient fashion to reduce processing time.

BACKGROUND OF THE INVENTION

U.S. Pat. No. 4,917,978, issued on Apr. 17, 1990 to Ritt et al. describes a method of manufacturing a screen assembly for a CRT by the electrophotographic screening (EPS) process. The method described in the aforementioned patent includes a "fusing" step followed by a "fixing" step to increase the adherence of the phosphors to an underlying organic photoconductive (OPC) layer deposited on the interior surface of the CRT faceplate panel. In the fusing step, vapors of a solvent, such as chlorobenzene, are permitted to contact and soak the OPC layer, formed of polyvinyl carbazole, and the polymeric coupling agent that coats the phosphor materials, to render the layer and the coating tacky. Vapor soaking takes on the order of 4 to 24 hours. The panels are then dried and "fixed" by spraying multiple layers of polyvinyl alcohol (PVA) in an alcohol-water mixture onto the fused phosphors. Each spray application required about 2 to 5 minutes to achieve complete screen coverage. The "fixed" screens are then filmed either by convention spray or emulsion filming. The process described in the patent is time consuming and does not lend itself to a production environment in which the screen processing time is measured in minutes rather than hours. Additionally, it has been determined that the PVA spray applications tend to move the phosphors slightly, which might be unacceptable, depending on the amount of movement.

One method of reducing the process time is described in U.S. Pat. No. 5,028,501, issued on Jul. 2, 1991 to Ritt et al. The method eliminates the vapor soaking of the phosphor materials and the underlying OPC layer and relies, instead, on the electrostatic attraction of the triboelectrically charged phosphors particles to the OPC layer to hold the materials in position until a dry-powdered filming resin is electrostatically deposited onto the phosphor materials. The filming resin is fused by using radiant heaters which melt the dry-powdered filming resin within 1 to 5 minutes. A drawback of this latter method is that while the electrostatic deposition of the dry-powdered filming resin does not move the phosphor materials, the heating step, to melt the resin, causes some movement of the underlying phosphors. While the movement is less than that experienced using the PVA spray, it is desirable that no movement of the phosphors occur.

A method of fusing the filming resin particles in an expedient fashion to either eliminate or substantially reduce the movement of the resin particles and, thus, that of the underlying phosphor particles is described in U.S. Pat. No. 5,229,233, issued on Jul. 20, 1993 to Riddle et al. In the Riddle et al. patent, a fogging apparatus is utilized to atomize the solvent so that the filming resin is at least partially solubilized and fused with the speed of a spray, but with the gentleness of the time-consuming vapor soak described in U.S. Pat. No. 4,917,978, cited above. Nevertheless, about 2 to 3 minutes are required to completely fuse the filming resin using the fogging apparatus.

In a production facility it is desirable to secure the phosphor materials to the OPC layer in about eight seconds, or less. To this end, it is of interest to develop a process in which the phosphor materials are securely fixed to the underlying OPC layer so that movement does not occur and the materials are then filmed in an expeditious manner, or alternatively, to modify the process in such a manner that the fixing step is carried out so that it is not necessary to have a separate filming step.

SUMMARY OF THE INVENTION

In accordance with the present invention, a method of electrophotographically manufacturing a luminescent screen assembly for a color CRT on an interior surface of a faceplate panel is described. A volatilizable, organic conductive (OC) layer is provided on the interior surface of the panel and a volatilizable, organic photoconductive (OPC) layer overlies the OC layer. The OPC layer comprises a polystyrene resin; 2,4-DMPBT as an electron donor material; and TNF and 2-EAQ as electron acceptor materials. The method includes the steps of: establishing a substantially uniform electrostatic charge on the OPC layer; exposing selected areas of the OPC layer to visible light to affect the charge thereon; developing the selected areas of the OPC layer with a triboelectricaily charged, dry-powdered, first color-emitting phosphor; sequentially repeating the charging, exposing and developing steps for triboelectricaily charged, dry-powdered, second and third color-emitting phosphors to form a luminescent screen comprising picture elements of triads of color-emitting phosphors; fixing the phosphors to the underlying OPC layer with a suitable fixative; and filming the phosphors. The present method is an improvement over prior methods because the fixing step utilizes an electrostatic spray to uniformly contact the phosphors and the underlying OPC layer with the fixative, without moving the phosphors. The fixative is a material selected from the group consisting of acetone, amyl acetate, butyl acetate, MEK, MIBK, toluene, xylene, a polymeric solution of an acrylic resin dissolved in MIBK, and polyalphamethyl styrene (AMS) dissolved in MIBK.

BRIEF DESCRIPTION OF THE DRAWINGS

FIG. 1 is a plan view, partially in axial section, of a color CRT made according to the present invention.

FIG. 2 is a section of a faceplate panel of the CRT of FIG. 1 showing a screen assembly.

DETAILED DESCRIPTION OF THE PREFERRED EMBODIMENTS

Figure 3:
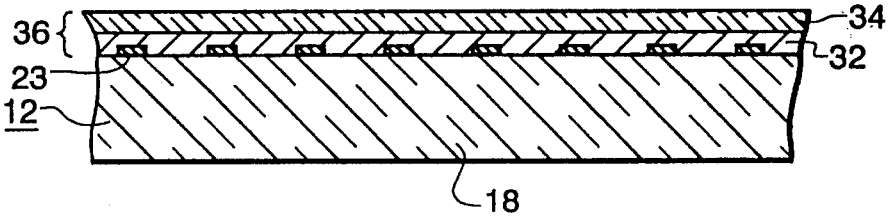
Fig. 3 PRIOR ART
FIGS. 3–7 show selected steps in the manufacturing operation.

FIG. 1 shows a color CRT 10 having a glass envelope 11 comprising a rectangular faceplate panel 12 and a tubular neck 14 connected by a rectangular funnel 15. The funnel 15 has an internal conductive coating (not shown) that contacts an anode button 16 and extends into the neck 14. The panel 12 comprises a viewing faceplate or substrate 18 and a peripheral flange or sidewall 20, which is sealed to the funnel 15 by a glass frit 21. A luminescent three color phosphor screen 22 is carried on the inner surface of the faceplate 18. The screen 22, shown in FIG. 2, is a line screen which includes a multiplicity of screen elements comprised of red-emitting, green-emitting and blue-emitting phosphor stripes R, G, and B, respectively, arranged in color groups or picture elements of three stripes or triads, in a cyclic order. The stripes extend in a direction which is generally normal to the plane in which the electron beams are generated. In the normal viewing position of the embodiment, the phosphor stripes extend in the vertical direction. Preferably, at least portions of the phosphor stripes overlap a relatively thin, light absorptive matrix 23, as is known in the art. Alternatively, the matrix can be formed after the screen elements are deposited, in the manner described in U.S. Pat. No. 5,240,798, issued to Ehemann, Jr., on Aug. 31, 1993. A dot screen also may be formed by the novel process. A thin conductive layer 24, preferably of aluminum, overlies the screen 22 and provides means for applying a uniform potential to the screen, as well as for reflecting light, emitted from the phosphor elements, through the faceplate 18. The screen 22 and the overlying aluminum layer 24 comprise a screen assembly. A multi-apertured color selection electrode or shadow mask 25 is removably mounted, by conventional means, in predetermined spaced relation to the screen assembly.

An electron gun 26, shown schematically by the dashed lines in FIG. 1, is centrally mounted within the neck 14, to generate and direct three electron beams 28 along convergent paths, through the apertures in the mask 25, to the screen 22. The electron gun is conventional and may be any stiltable gun known in the art.

The tube 10 is designed to be used with an external magnetic deflection yoke, such as yoke 30, located in the region of the funnel-to-neck junction. When activated, the yoke 30 subjects the three beams 28 to magnetic fields which cause the beams to scan horizontally and vertically, in a rectangular raster, over the screen 22. The initial plane of deflection (at zero deflection) is shown by the line P—P in FIG. 1, at about the middle of the yoke 30. For simplicity, the actual curvatures of the deflection beam paths, in the deflection zone, are not shown.

The screen is manufactured by an electrophotographic screening (EPS) process that is shown schematically in FIGS. 3 through 10. Initially, the panel 12 is cleaned by washing it with a caustic solution, rinsing it in water, etching it with buffered hydrofluoric acid and rinsing it again with water, as is known in the art. The interior surface of the viewing faceplate 18 is then provided with the light absorbing matrix 23, preferably, using the conventional wet matrix process described in U.S. Pat. No. 3,558,310, issued to Mayaud on Jan. 26, 1971. In the wet matrix process, a suitable photoresist solution is applied to the interior surface, e.g., by spin coating, and the solution is dried to form a photoresist layer. Then, the shadow mask is inserted into the panel and the panel is placed onto a three-in-one lighthouse which exposes the photoresist layer to actinic radiation from a light source which projects light through the openings in the shadow mask. The exposure is repeated two more times with the light source located to simulate the paths of the electron beams from the three electron guns. The light selectively alters the solubility of the exposed areas of the photoresist layer where phosphor materials will subsequently be deposited. After the third exposure, the panel is removed from the lighthouse and the shadow mask is removed from the panel. The photoresist layer is developed, using water, to remove the more soluble areas thereof, thereby exposing the underlying interior surface of the faceplate, and leaving the less soluble, exposed areas of the photoresist layer intact. Then, a suitable solution of light-absorbing material is uniformly provided onto the interior surface of the faceplate 18 to cover the exposed portion of the faceplate and the retained, less soluble, areas of the photoresist layer. The layer of light-absorbing material is dried and developed using a suitable solution which will dissolve and remove the retained portion of the photoresist layer and the overlying light-absorbing material, forming windows in the matrix layer which is adhered to the interior surface of the faceplate. For a panel 12 having a diagonal dimension of 51 cm (20 inches), the window openings formed in the matrix have a width of about 0.13 to 0.18 mm, and the matrix lines have a width of about 0.1 to 0.15 min. The interior surface of the faceplate 18, having the matrix 23 thereon, is then coated with a suitable layer 32 of a volatilizable, organic conductive (OC) material which provides an electrode for an overlying volatilizable, organic photoconductive (OPC) layer 34. The OC layer 32 and the OPC layer 34 are shown in FIG. 3 and, in combination, comprise a photoreceptor 36.

Figure 4:
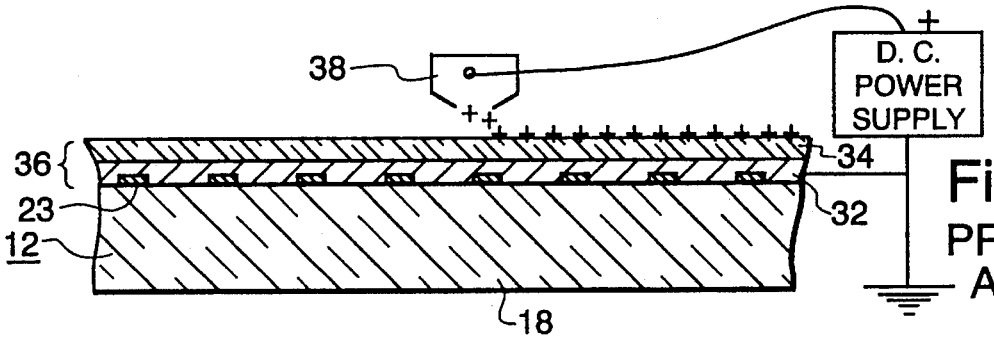
Fig. 4 PRIOR ART
Figure 5:
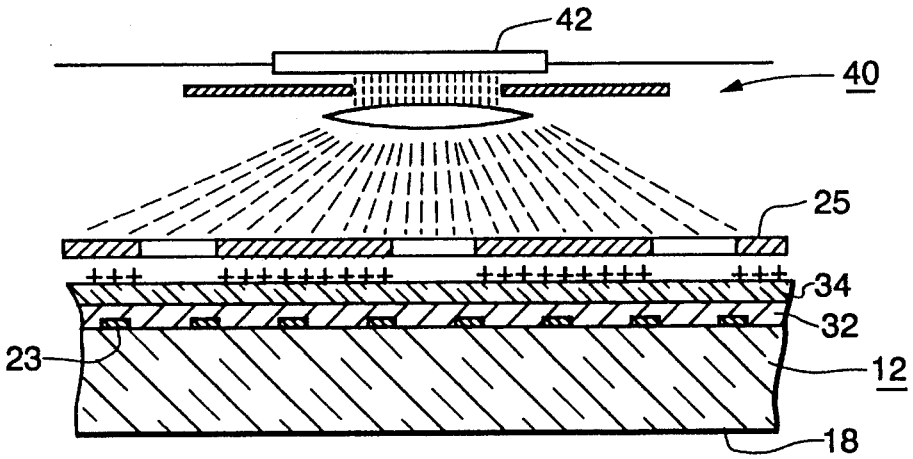
Fig. 5 PRIOR ART
Figure 6:
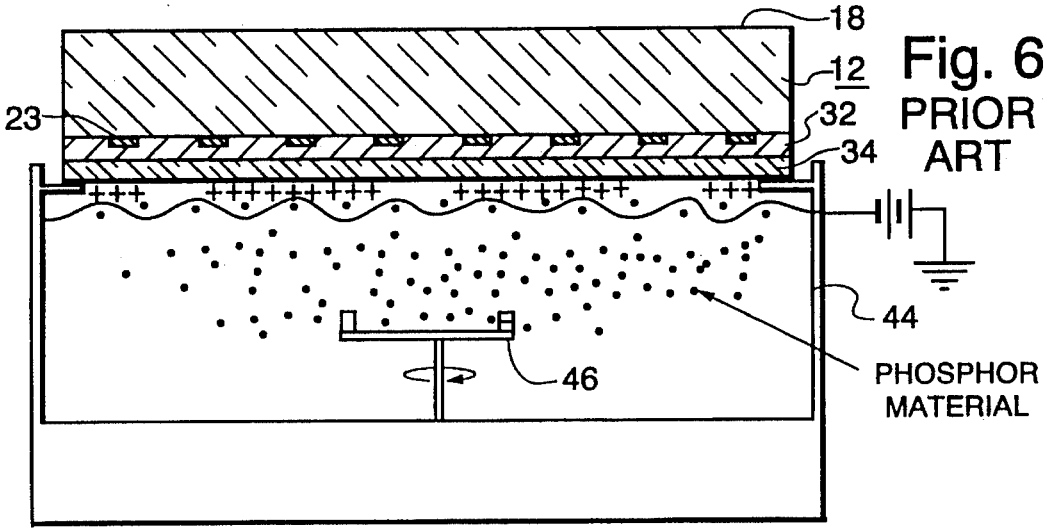
Fig. 6 PRIOR ART
Figure 7:
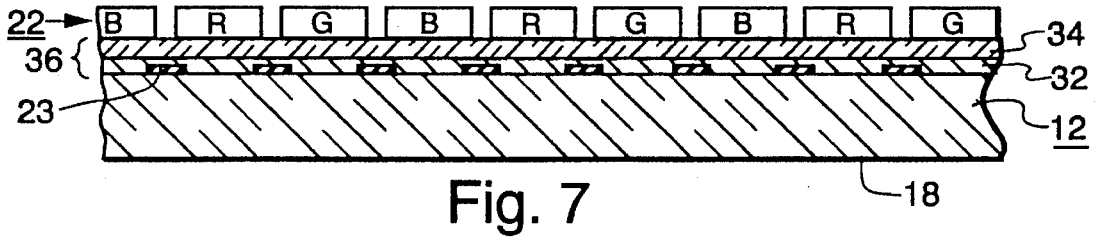
Fig. 7 PRIOR ART

Suitable materials for the OC layer 32 include certain quaternary ammonium polyelectrolytes recited in U.S. Pat. No. 5,370,952, issued on Dec. 6, 1994, to Datta et al. Preferably, the OPC layer 34 is formed by coating the OC layer 32 with a solution containing polystyrene; an electron donor material, such as 1,4-di(2,4-methyl phenyl)-1,4 diphenylbutatriene (hereinafter 2,4-DMPBT); electron acceptor materials, such as 2,4,7-trinitro-9-fluorenone (hereinafter TNF) and 2-ethylanthroquinone (hereinafter 2-EAQ); and a solvent, such as toluene or xylene. A surfactant, such as silicone U-7602 and a plasticizer, such as dioctyl phthalate (hereinafter DOP), also may be added to the solution. The surfactant U-7602 is available from Union Carbide, Danbury Conn. As shown in FIG. 4, the OPC layer 34 is uniformly electrostatically charged using a corona discharge device 38, described in U.S. Pat. No. 5,083,959, issued on Jan. 28, 1992 to Datta et al, which charges the OPC layer 34 to a voltage within the range of approximately +200 to +700 volts. The shadow mask 25 is then inserted into the panel 12, which is placed onto a lighthouse 40, shown schematically in FIG. 5, and the positively charged OPC layer 34 is exposed, through the shadow mask 25, to light from a xenon flash lamp 42, or other light source of sufficient intensity, such as a mercury arc, disposed within the lighthouse. The light which passes through the apertures in the shadow mask 25, at an angle identical to that of one of the electron beams from the electron gun of the tube, discharges the illuminated areas on the OPC layer 34 on which it is incident. The shadow mask is removed from the panel 12 and the panel is placed onto a first phosphor developer 44, such as that shown in FIG. 6. The first color-emitting phosphor material is positively triboelectrical charged within the developer 44 by a triboelectric gun 46 and directed toward the OPC layer 34. The positively charged first color-emitting phosphor material is repelled by the positively charged areas on the OPC layer 34 and deposited onto the discharged areas thereof by the process known in the art as "reversal" development. In reversal development, triboelectrically charged particles of screen structure material are repelled by similarly charged areas of the OPC layer 34 and deposited onto the discharged areas thereof. The size of each of the lines of the first color-emitting phosphor is slightly larger than the size of the openings in the light-absorbing matrix to provide complete coverage of each opening, and a slight overlap of the light-absorbing matrix material surrounding the openings. The panel 12 is then recharged using the above-described corona discharge apparatus. A positive voltage is established on the OPC layer 34 and on the first color-emitting phosphor material deposited thereon. The light exposure and phosphor development steps are repeated for each of the two remaining color-emitting phosphors. The size of each of the lines of the other two color-emitting phosphors on the OPC layer 34 also is larger than the size of the matrix openings, to ensure that no gaps occur and that a slight overlap of the light-absorbing matrix material surrounding the openings is provided. The resultant screen 22 is shown in FIG. 7.

Figure 8:
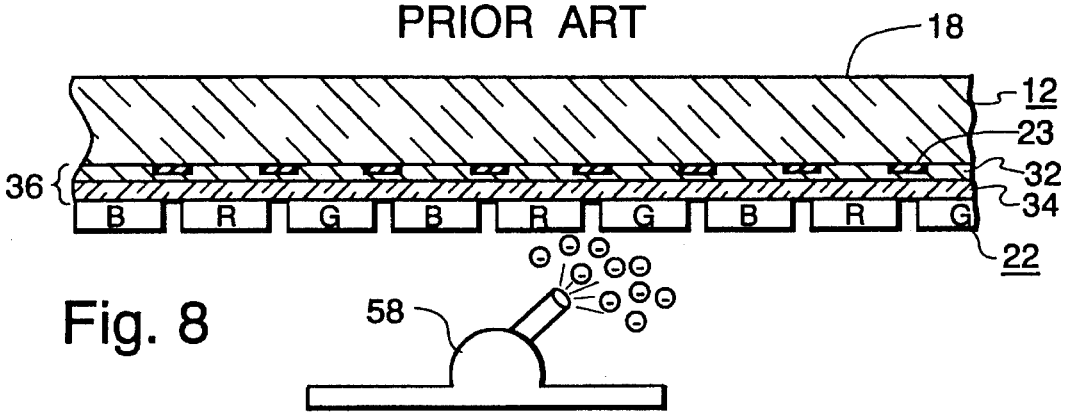
FIG. 8 shows a schematic representation of electrostatic spray fixing.

The three light-emitting phosphors are fixed to the above-described OPC layer 34 by contacting the phosphors with a suitable fixative that is electrostatically charged by an electrostatic spray gun 58, schematically shown in FIG. 8. Suitable fixatives include such solvents as acetone; amyl acetate; butyl acetate; methyl isobutyl ketone (MIBK); methyl ethyl ketone (MEK); toluene; and xylene; and polymeric solutions, such as acrylic resin dissolved in MIBK; and poly-alphamethyl styrene (AMS) dissolved in MIBK.

Figure 9:
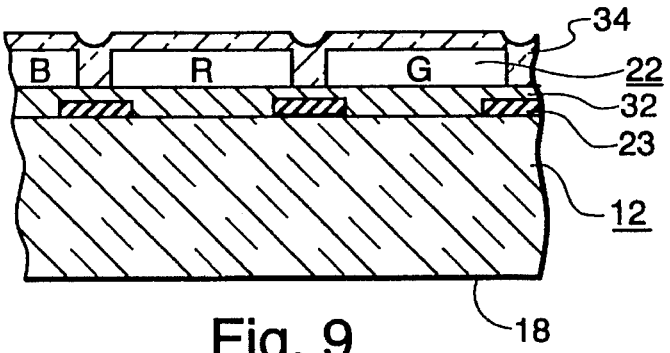
FIG. 9 shows a section of the screen assembly after the fixing step in the manufacturing operation.

Any one of the above-mentioned solvents may be used to fix the phosphors to the underlying OPC layer 34. The preferred electrostatic spray gun is an AEROBELL™ model, available from ITW Ransberg, Toledo, Ohio. The electrostatic gun provides negatively charged droplets of uniform size which wet the phosphors and the underlying OPC layer 34, without moving the phosphors. As shown in FIG. 8, the panel 12 is oriented with the OPC layer 34 and the phosphors directed downwardly toward the electrostatic gun 58. The downward orientation of the panel prevents any large droplets forming on the gun from dropping onto the screen 22 and moving the phosphors. The polystyrene used in the OPC layer 34 is completely soluble in amyl acetate, butyl acetate, MIBK, toluene and xylene, and partially soluble in acetone, the former all having a boiling point within the range of 100° to 150° C. MIBK, however, is preferred because it dissolves the polystyrene of the OPC layer 34 more slowly than the other solvents. The phosphors are then filmed to provide a layer which forms a smooth surface over the screen 22 onto which an evaporated aluminum layer is deposited. The filming may be a conventional emulsion filming, or the dry filming described in the above-cited U.S. Pat. No. 5,028,501, or the filming may comprise an electrostatically deposited polymeric solution, as described hereinafter. After filming, the screen assembly is aluminized and then baked at a temperature of about 425° C. for about 30 minutes, to drive off the volatilizable constituents of the screen assembly. The fixative MIBK is preferred with the present electrostatic spray system because the phosphors are substantially completely encapsulated within the dissolved polystyrene-based OPC layer 34, as shown in FIG. 9, without distorting the phosphor lines and cracking, or otherwise adversely effecting, the structure of the OPC layer. While filming of the encapsulated phosphors is not required, it is, nevertheless, desirable in order to provide a smooth surface on which to deposit the evaporated aluminum layer.

The preferred filming material solution is an acrylic resin dissolved in MIBK. Good results have been obtained using a resin, available from Pierce and Stevens, Buffalo, N.Y., comprising about 90 wt. % of polymethyl methacrylate, 9 wt. % of isobutyl methacrylate, and the balance being the plasticizer DOP, and nitrocellulose. The resin solids comprise about 3 to 10 wt. % of the filming solution. Another suitable resin is poly-alphamethyl styrene (AMS) dissolved in MIBK. The AMS comprises about 3 to 15 wt. %, and preferably 3 to 10 wt. %, of the solution. AMS is commercially available as Herculite 240, from Hercules, Inc., Wilmington, Del.

Figure 10:
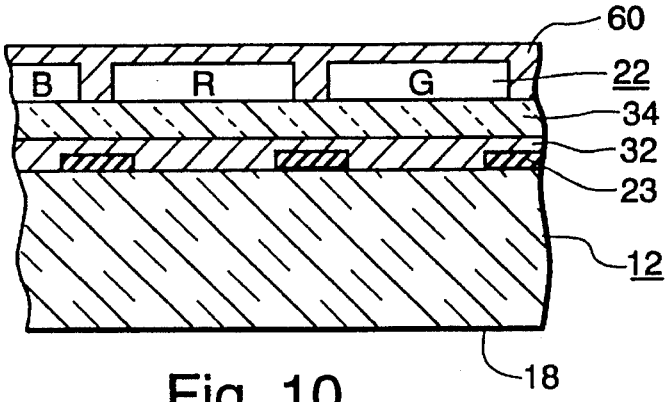
FIG. 10 shows a section of the screen assembly after a combined fixing and filming step in the manufacturing operation.

In another embodiment of the present invention, shown in FIG. 10, the phosphors are fixed and filmed simultaneously, i.e., in one-step, using B-67 acrylic resin dissolved in MIBK. B-67 is available from RHOM and HAAS, Philadelphia, Pa. Screen samples were prepared having film thicknesses ranging from 5 to 15 microns (u). A 10 u thick B-67 acrylic film 60 produced smooth coverage of the phosphors. The thickness of the film 60 is determined by the concentration of the solid resin in the solution and by the number of passes made across the phosphor screen by the electrostatic gun 58.

An alternative to the above described one-step method of fixing and filming is to fix and film in separate steps. The fixing step is accomplished by electrostatically spraying a thin coating, not shown, of a solution comprising 1 to 5 wt. % of B-67 acrylic resin dissolved in MIBK onto the phosphors of the screen 22. Then, the fixed screen is overcoated by electrostatically spraying a solution comprising 5 to 15 wt. % of the B-67 acrylic resin, also dissolved in MIBK, onto the fixed screen, to provide a filming layer, also not shown, having a thickness within the range of about 5 to 10 u. It has been determined that thermal decomposition of the acrylic B-67 begins at 205 ° C. and the material bakes out rapidly at 336° C. This rapid decomposition of the filming material is believed to cause outgassing that produces blisters in the aluminum layer during screen bake. It is further believed that the blister problem can be solved by adjusting the screen bake parameters to provide a slower, i.e., longer, bake cycle, to permit the gas evolved from the decomposition of the volatilizable materials to pass through the aluminum layer without causing it to blister; however, in manufacturing screens by the EPS process, it is desirable to decrease the screen processing time, thus, other filming materials were investigated.

One such material is AMS which bakes out cleanly at 440° C. and decomposes more slowly than B-67, so that blisters are less likely to form. A solution of 5 wt. % AMS dissolved in MIBK was electrostatically sprayed onto the phosphors to fix them to the OPC layer 34. The fixing layer had a thickness of one micron. The fixing layer was overcoated with a 10 u thick filming layer formed by a solution of 15 wt. % AMS dissolved in MIBK. The panels were aluminized and baked, and were free of blisters.

What is claimed is:

1. In a method of manufacturing a luminescent screen assembly for a color CRT on an interior surface of a faceplate panel thereof, said interior surface of said panel being provided with a volatilizable organic conductive (OC) layer and overcoated with a volatilizable organic photoconductive (OPC) layer, said OPC layer comprising a polystyrene resin; 2,4-DMPBT as an electron donor material; and TNF and 2-EAQ as electron acceptor materials, said method including the steps of:

a) establishing a substantially uniform electrostatic charge on said OPC layer;

b) exposing selected areas of said OPC layer to visible light to affect the charge thereon;

c) developing the selected areas of said OPC layer with a triboelectrically charged, dry-powdered, first color-emitting phosphor;

d) sequentially repeating steps a, b and c for triboelectrically charged, dry-powdered, second and third color-emitting phosphors to form a luminescent screen comprising picture elements of triads of color-emitting phosphors; and e) fixing said phosphors to the underlying OPC layer with a suitable fixative; the improvement wherein said fixing step including electrostatic spraying said fixative to rapidly secure said phosphors to said underlying OPC layer, without moving said phosphors, said fixative being selected from the group consisting of acetone, amyl acetate, butyl acetate, MIBK, MEK, toluene, xylene, a polymeric solution of an acrylic resin dissolved in MIBK, and polyalphamethyl styrene dissolved in MIBK.

2. The method as described in claim 1, further including the step of filming said screen.

3. The method as described in claim 2, wherein said filming step includes spraying an acrylic fihning resin dissolved in a suitable solvent onto said fixed phosphor screen.

4. The method as described in claim 3, wherein said filming resin comprising polymethyl methacrylate and isobutyl methacrylate, and said solvent being MIBK.

5. The method as described in claim 3, wherein said filming resin comprising AMS and said solvent being MIBK.

6. The method as described in claim 3, wherein said resin being B-67 and said solvent MIBK.

7. The method as described in claim 2, further including the steps of:

i) aluminizing said screen to form said screen assembly; and ii) baking said screen assembly to remove the volatilizable constituents therefrom.

8. In a method of manufacturing a luminescent screen assembly for a color CRT on an interior surface of a faceplate panel thereof, said interior surface of said panel being provided with a volatilizable organic conductive (OC) layer and overcoated with a volatilizable organic photoconductive (OPC) layer, said OPC layer comprising polystyrene resin; 2,4-DMPBT as an electron donor material; and TNF and 2-EAQ as electron acceptor materials, said method including the steps of:

a) establishing a substantially uniform electrostatic charge on said OPC layer;

b) exposing selected areas of said OPC layer to visible light to affect the charge thereon;

c) developing the selected areas of said OPC layer with a triboelectrically charged, dry-powdered, first color-emitting phosphor;

d) sequentially repeating steps a, b and c for triboelectrically charged, dry-powdered, second and third color-emitting phosphors to form a luminescent screen comprising picture elements of triads of color-emitting phosphors; and e) simultaneously fixing and filming said phosphors to the underlying OPC layer with a suitable solvent; the improvement wherein said simultaneous fixing and filming step including electrostatic spraying said solvent having a boiling point within the range of about 100° to 150° C., onto said phosphors and said OPC layer without moving said phosphors, whereby said OPC layer is dissolved so as to substantially totally encapsulate said phosphors.

9. The method as described in claim 8, wherein said solvent is selected form the group consisting of MIBK, toluene, xylene, butyl acetate and amyl acetate.

10. The method as described in claim 8, further including the steps of:

i) aluminizing said encapsulated phosphors to form said screen assembly; and ii) baking the screen assembly to remove the volatilizable constituents therefrom.

11. In a method of manufacturing a luminescent screen assembly for a color CRT on an interior surface of a faceplate panel thereof, said interior surface of said panel being provided with a volatilizable organic conductive (OC) layer and overcoated with a volatilizable organic photoconductive (OPC) layer, said OPC layer comprising a polystyrene resin; 2,4-DMPBT as an electron donor material; and TNF and 2-EAQ as electron acceptor materials, said method including the steps of:

a) establishing a substantially uniform electrostatic charge on said OPC layer;

b) exposing selected areas of said OPC layer to visible light to affect the charge thereon;

c) developing the selected areas of said OPC layer with a triboelectrically charged, dry-powdered, first color-emitting phosphor;

d) sequentially repeating steps a, b and c for triboelectrically charged, dry-powdered, second and third color-emitting phosphors to form a luminescent screen comprising picture elements of triads of color-emitting phosphors; and e) fixing said phosphors to the underlying OPC layer with a suitable fixative; the improvement wherein said fixing step including electrostatic spraying charged droplets of said fixative to wet said phosphors and the underlying OPC layer, to rapidly secure said phosphors thereto without moving said phosphors, said fixative being selected from the group of solvents consisting of acetone, amyl acetate, butyl acetate, MIBK, MEK, toluene, and xylene.

12. The method as described in claim 11, further including the step of filming said screen.

13. The method as described in claim 12, wherein said filming step includes spraying an acrylic filming resin dissolved in a suitable solvent onto said fixed phosphor screen.

14. The method as described in claim 13, wherein said filming resin comprising polymethyl methacrylate and isobutyl methacrylate, and said solvent being MIBK.

* * * * *

UNITED STATES PATENT AND TRADEMARK OFFICE

CERTIFICATE OF CORRECTION

PATENT NO. : 5,474,866

DATED : Dec. 12, 1995

INVENTOR(S) : Peter Michael Ritt et al.

It is certified that error appears in the above-indentified patent and that said Letters Patent is hereby corrected as shown below:

Col. 1 lines 12&13 after "Ritt et al." add --,--.

Col. 4, line 14, after "0.15" change "min"to--mm--.

Col.4, line 38, after "Datta et al" add --.--.

Signed and Sealed this

Ninth Day of July, 1996

Bruce Lehman

*Attest:*

BRUCE LEHMAN

*Attesting Officer*

*Commissioner of Patents and Trademarks*